US012171283B2

(12) United States Patent
Peterson

(10) Patent No.: US 12,171,283 B2
(45) Date of Patent: Dec. 24, 2024

(54) AMMUNITION STORAGE ASSEMBLY

(71) Applicant: Lyle Peterson, East Peoria, IL (US)

(72) Inventor: Lyle Peterson, East Peoria, IL (US)

( * ) Notice: Subject to any disclaimer, the term of this patent is extended or adjusted under 35 U.S.C. 154(b) by 185 days.

(21) Appl. No.: 18/101,406

(22) Filed: Jan. 25, 2023

(65) Prior Publication Data

US 2024/0245147 A1 Jul. 25, 2024

(51) Int. Cl.
*F42B 39/02* (2006.01)
*A41D 13/00* (2006.01)

(52) U.S. Cl.
CPC ..... *A41D 13/0012* (2013.01); *F42B 39/02* (2013.01); *A41D 2600/108* (2013.01)

(58) Field of Classification Search
CPC ..... F42B 39/08; Y10S 224/931; A45F 5/022; A45F 5/02; A45F 2003/006; A45F 2003/008; A45F 2005/006; A45F 2005/008
USPC ..... 224/931, 230
See application file for complete search history.

(56) References Cited

U.S. PATENT DOCUMENTS 1,175,878 A * 3/1916 Bates ..... F42B 39/02 224/931
2,193,310 A 3/1940 Brant
2,605,033 A 7/1952 Terry
3,797,717 A * 3/1974 Collins ..... A45C 11/00 224/230
4,047,650 A 9/1977 Domingos
5,186,373 A * 2/1993 Taylor ..... A45F 5/02 224/183
5,265,365 A 11/1993 Finn
5,839,167 A * 11/1998 Wagner ..... A45F 5/02 24/3.12
6,193,125 B1 * 2/2001 Grover ..... B25H 3/006 224/678
6,874,618 B1 4/2005 Cragg
6,981,624 B2 * 1/2006 Link ..... F42B 39/02 206/315.11
8,393,504 B2 3/2013 Scott
10,274,295 B2 * 4/2019 Peelgrane ..... F42B 7/02
10,724,839 B2 * 7/2020 Cahill ..... A41D 27/20
D957,122 S 7/2022 Jones
2022/0265032 A1 * 8/2022 Datcher ..... A61L 2/26

FOREIGN PATENT DOCUMENTS

CA 2101020 A * 1/1995 ..... F42B 39/02
WO WO2005103598 11/2005

* cited by examiner

*Primary Examiner* — Scott T McNurlen

(57) ABSTRACT

An ammunition storage assembly includes a pocket insert that has a rear flap spaced from a front flap thereby facilitating the rear flap to be inserted into a pocket on an article of clothing. A pair of strips is each attached to the front flap at a plurality of strip attachment points such that a plurality of arches is defined in each of the strips to insertably receive a round of ammunition for storage. A button is coupled to and extends away from the front flap for inserting or removing the rear flap in the pocket on the article of clothing. A lanyard is removably attached to the front flap such that the lanyard can be wrapped around a respective one of the user's legs when the rear flap is inserted into the user's pants pocket.

8 Claims, 7 Drawing Sheets

AMMUNITION STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for storing ammunition and hunting documents. The device includes a pocket insert which as a rear flap that is insertable into a pocket in an article of clothing such that a front flap is exposed. The device includes a plurality of strips which each has a plurality of attachment points to define a plurality of arches to insertably receive ammunition for storage. The device includes a button attached to the front flap and a lanyard attached to the front flap.

(2) Description of Related Art Including Information Disclosed Under 37 CFR 1.97 and 1.98

The prior art relates to storage devices including an ammunition storage device that includes a first flap that is foldable over a second flap and a plurality of fasteners for releasably retaining the first flap in a closed position. The prior art discloses a variety of ammunition storage devices that are each structured to accommodate a butt of a rifle.

BRIEF SUMMARY OF THE INVENTION

An embodiment of the disclosure meets the needs presented above by generally comprising a pocket insert that has a rear flap spaced from a front flap thereby facilitating the rear flap to be inserted into a pocket on an article of clothing. A pair of strips is each attached to the front flap at a plurality of strip attachment points such that a plurality of arches is defined in each of the strips to insertably receive a round of ammunition for storage. A button is coupled to and extends away from the front flap for inserting or removing the rear flap in the pocket on the article of clothing. A lanyard is removably attached to the front flap such that the lanyard can be wrapped around a respective one of the user's legs when the rear flap is inserted into the user's pants pocket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
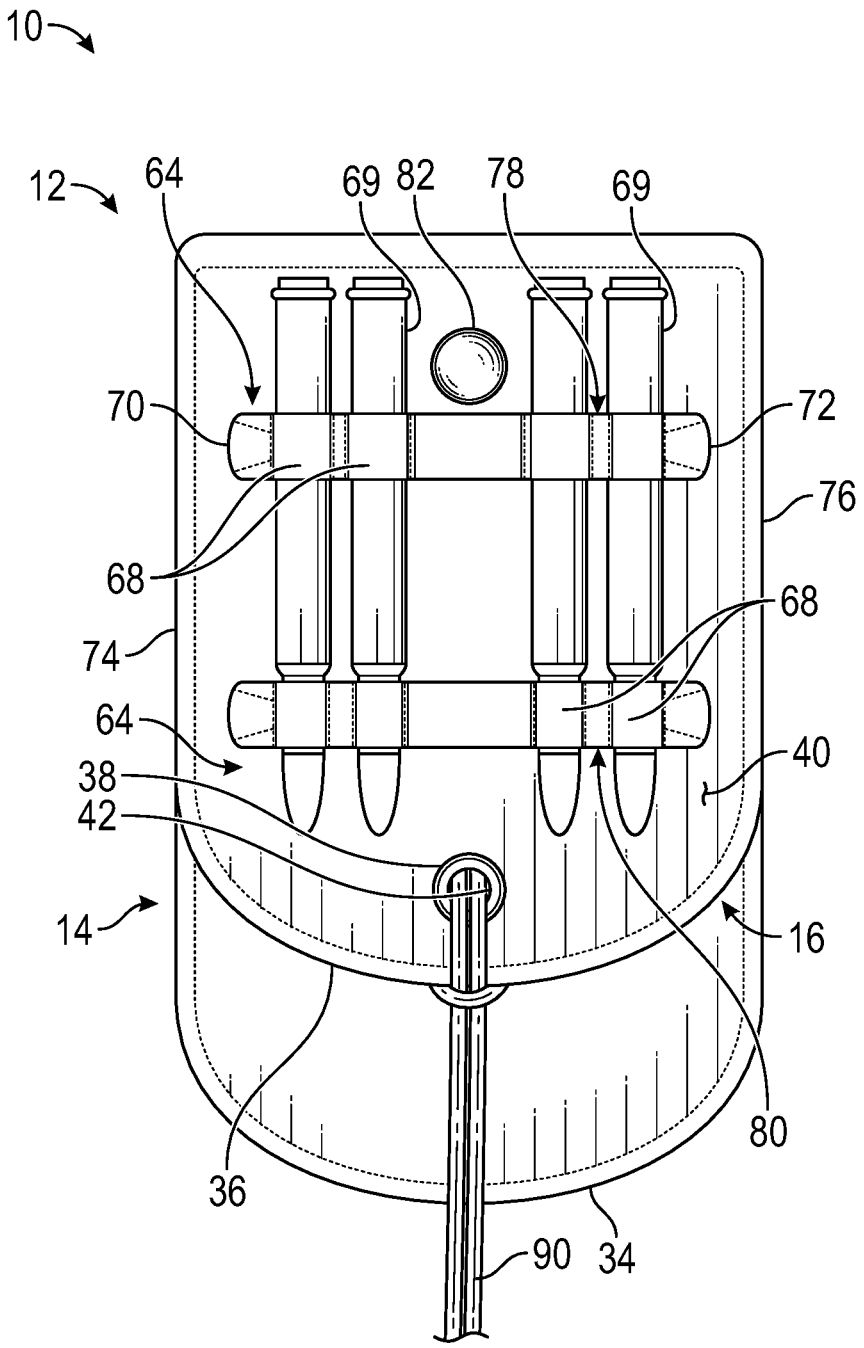
FIG. 1 is a front view of an ammunition storage assembly according to an embodiment of the disclosure.
Figure 2:
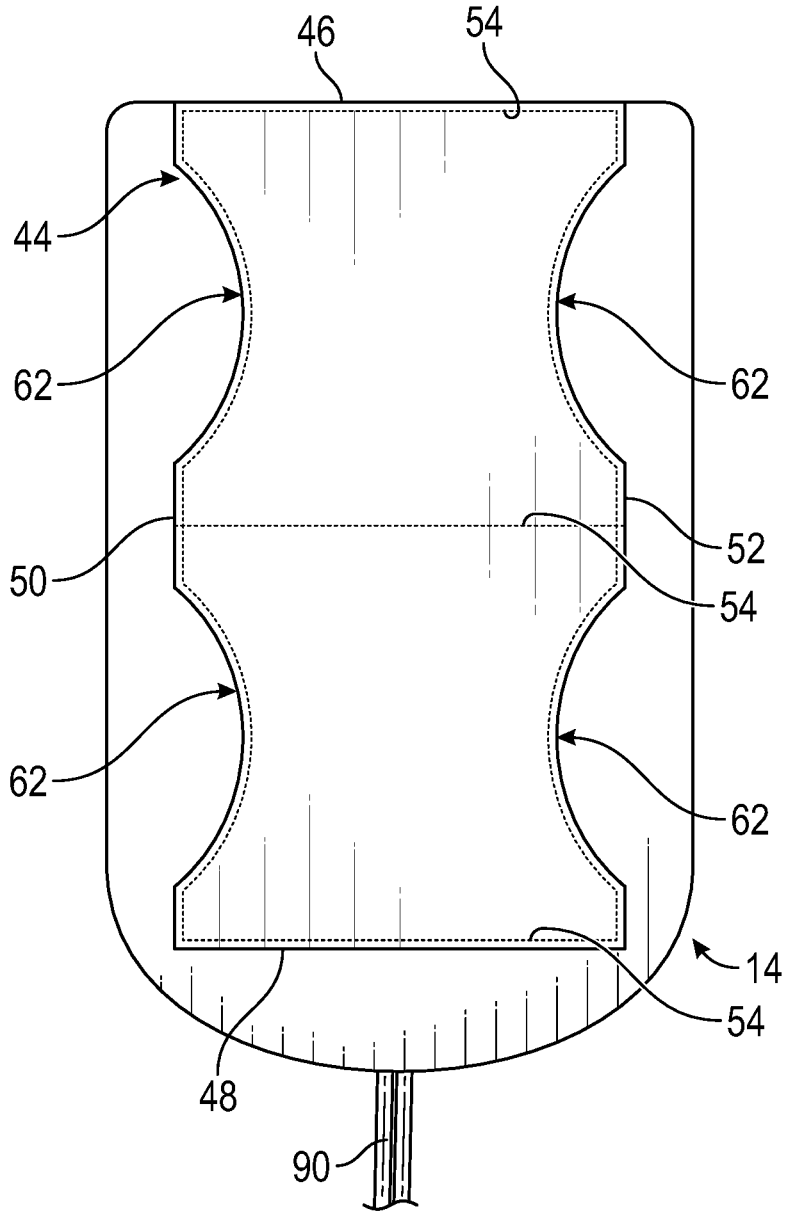
FIG. 2 is a back view of an embodiment of the disclosure.
Figure 3:
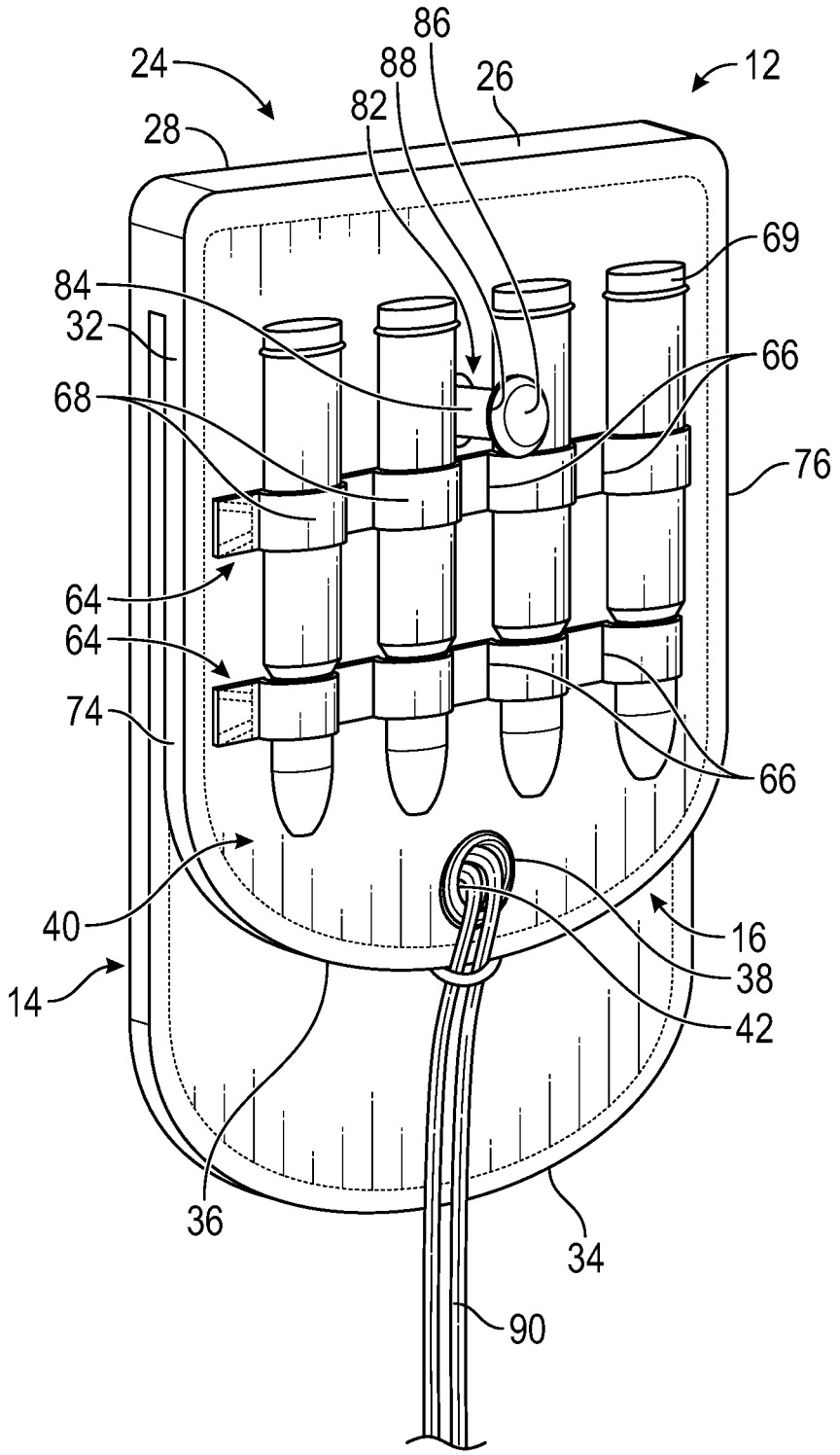
FIG. 3 is a front perspective view of an embodiment of the disclosure.
Figure 4:
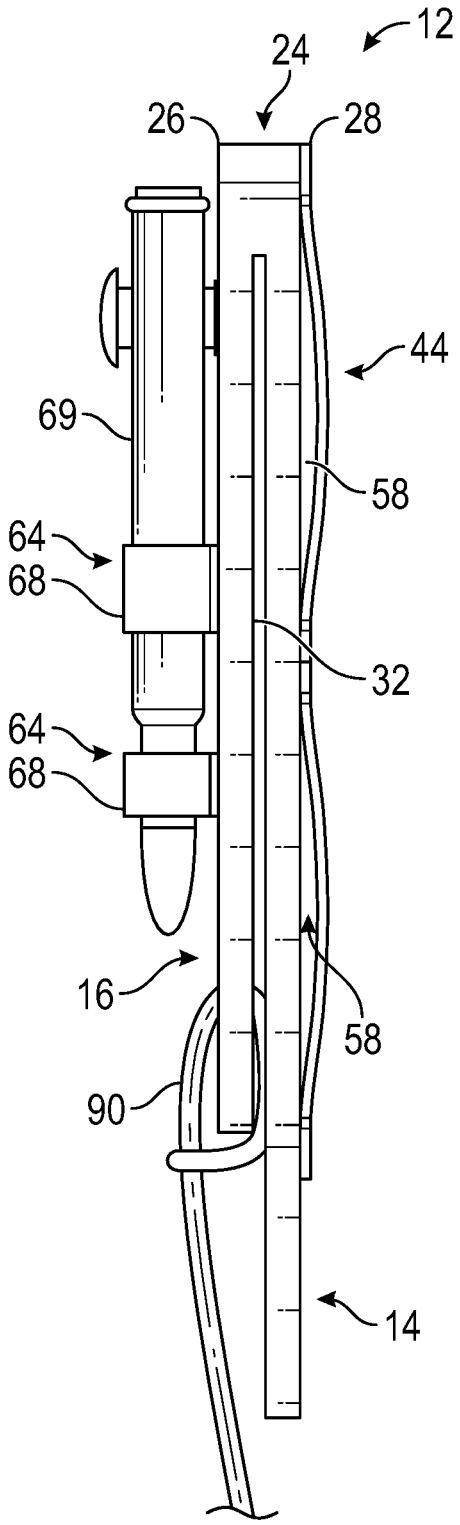
FIG. 4 is a left side view of an embodiment of the disclosure.
Figure 5:
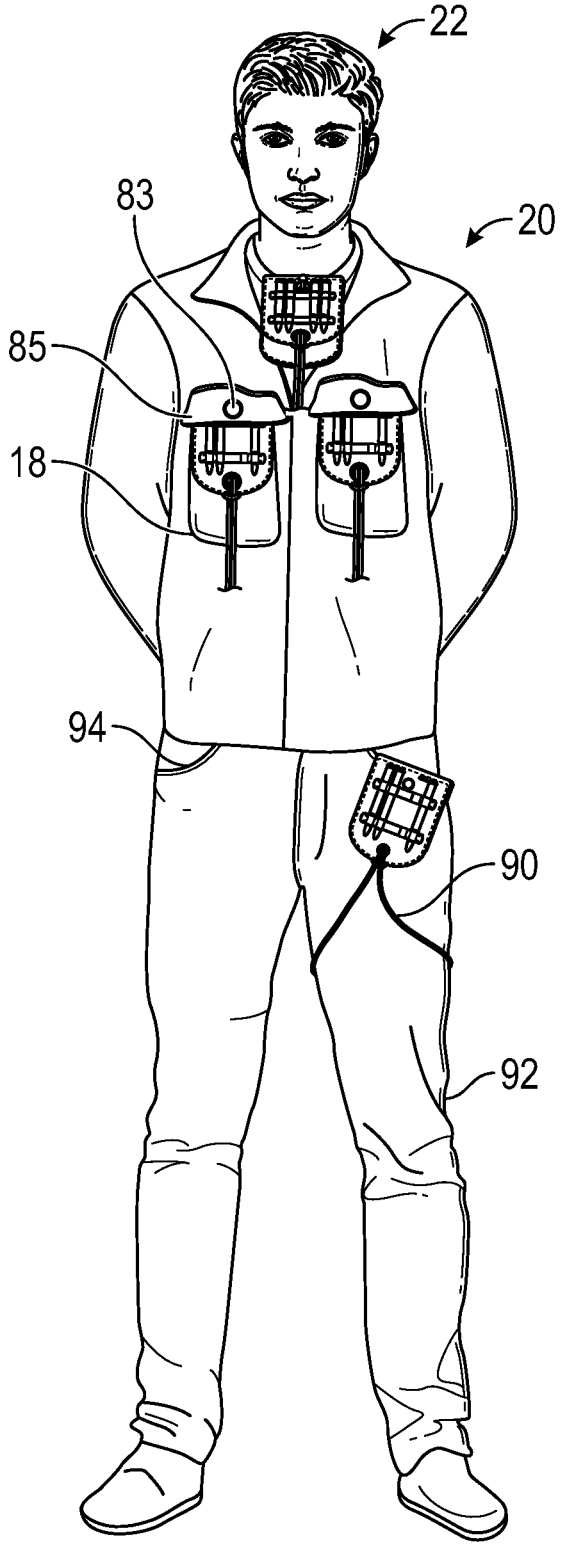
FIG. 5 is a perspective in-use view of an embodiment of the disclosure.
Figure 6:
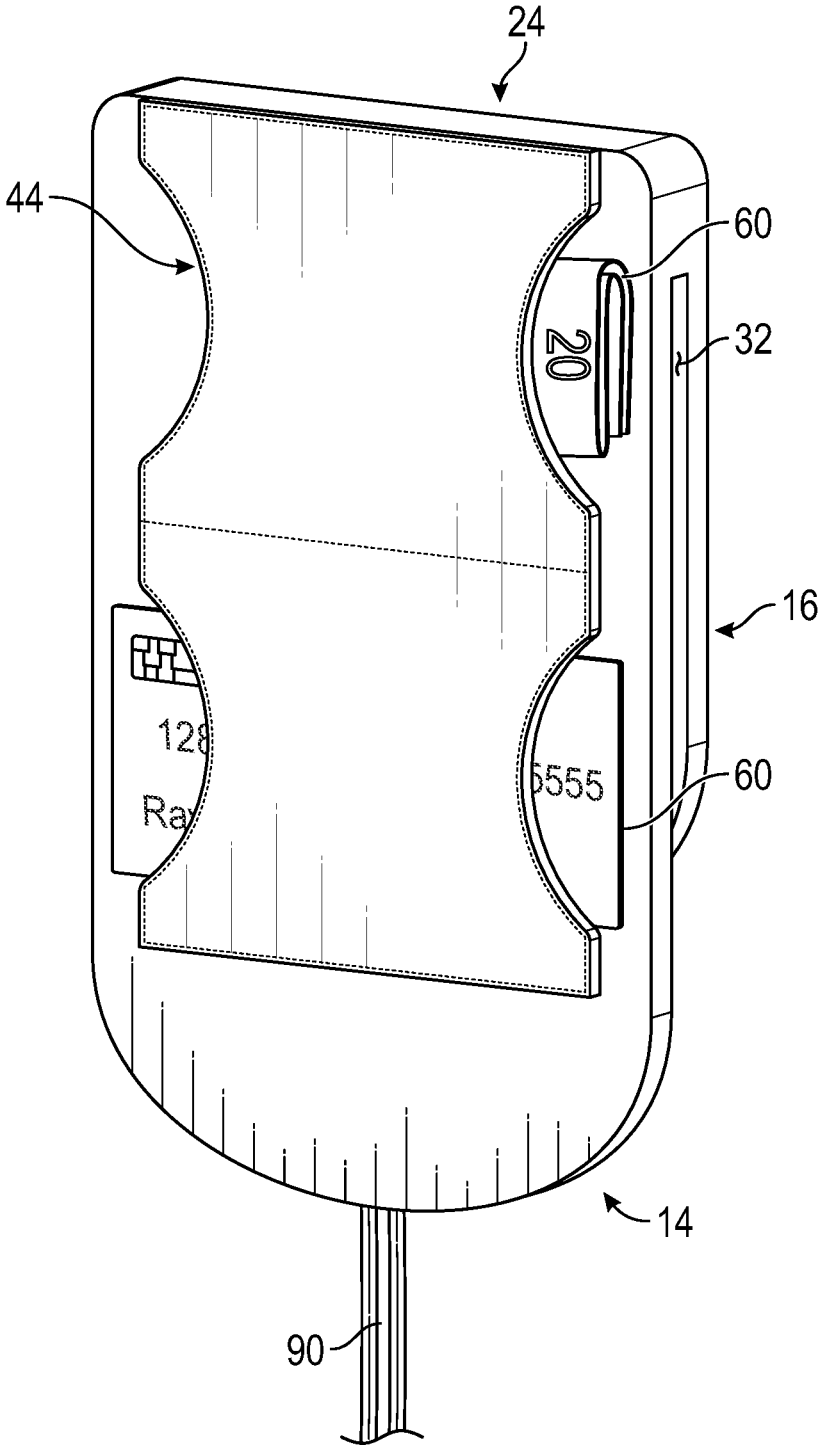
FIG. 6 is a back perspective view of an embodiment of the disclosure.

With reference now to the drawings, and in particular to FIGS. 1 through 7 thereof, a new storage device embodying the principles and concepts of an embodiment of the disclosure and generally designated by the reference numeral 10 will be described.

As best illustrated in FIGS. 1 through 7, the ammunition storage assembly 10 generally comprises a pocket insert 12 that has a rear flap 14 which is spaced from a front flap 16. The rear flap 14 can be inserted into a pocket 18 on an article of clothing 20 such that the front flap 16 is exposed on the article of clothing 20. In this way the front flap 16 is accessible to a user 22 wearing the article of clothing 20. The article of clothing 20 may be hunting jacket, for example, and the user 22 may be a hunter that is hunting with a firearm.

The pocket insert 12 has a central portion 24 extending between a top end 26 of the front flap 16 and an upper end 28 of the rear flap 14 such that a rear surface 30 of the front flap 16 is spaced from a front surface 32 of the rear flap 14. The rear flap 14 has a length that is greater than a length of the front flap 16 such that a bottom end 34 of the rear flap 14 is spaced below a lower end 36 of the front flap 16 and each of the bottom end 34 and the lower end 36 is rounded. The pocket insert 12 may be comprised of a resilient material, including but not being limited to leather or canvas, such that the pocket insert 12 is weather resistant. The front flap 16 has a grommet 38 extending through a forward surface 40 of the front flap 16 and the rear surface 30 of the front flap 16 such that the grommet 38 defines an opening 42 in the front flap 16. Additionally, the grommet 38 is spaced from the lower end 36 of the front flap 16.

A panel 44 is provided which has an upper end 46, a lower end 48, a first lateral side 50 and a second lateral side 52. The panel 44 has a plurality of panel attachment points 54 which each engages a back surface 56 of the rear flap 14 and each of the plurality of panel attachment points 54 extends between the first lateral side 50 and the second lateral side 52. The panel attachment points 54 are spaced apart from each other and are evenly distributed between the upper end 46 and the lower end 48 of the panel 44 thereby defining a pair of sleeves 58 between respective pairs of the panel attachment points 54. Each of the sleeves 58 can insertably receive respective hunting documents 60 for storage. The hunting documents 60 may include a hunting license, an identification card and other documents commonly required to be carried while hunting. Furthermore, currency and credit cards or any other objects that might be typically carried in a wallet can be inserted into a respective sleeve 58. The each of the first lateral side 50 and the second lateral side 52 is scalloped between the upper end 28 and the lower end 36 and each of the scallops 62 is aligned with a respective one of the sleeves 58 defined in the panel 44. Each of the plurality of panel attachment points 54 may comprise stitching which extends through the panel 44 and the rear flap 14.

A pair of strips 64 is each attached to the front flap 16 at a plurality of strip attachment points 66 such that a plurality of arches 68 is defined in each of the strips 64. In this way each of the arches 68 in each of the strips 64 can insertably receive a round of ammunition 69 for storage. Each of the strips 64 has a first end 70 and a second end 72 and each of the pair of strips 64 is positioned on the forward surface 40 of the front flap 16. Each of the plurality of strip attachment points 66 is spaced apart from each other and is distributed between the first end 70 and the second end 72 of a respective one of the pair of strips 64. A plurality of the strips 64 might be provided, a single strip 64 might be provided, or any conceivable number of strips 64 depending upon the type of ammunition 69 that is being stored.

Each of the pair of strips 64 extends substantially between a first lateral edge 74 and a second lateral edge 76 of the front flap 16. The strips 64 are spaced apart from each other and are distributed between the top end 26 and the bottom end 34 of the front flap 16 having the plurality arches 68 in a topmost one of the pair of strips 78 being aligned with a respective one of the arches 68 in a bottommost one of the pair of strips 80. Additionally, each of the strips 64 may be comprised of a variety of appropriate materials, including but not being limited to, an elastomeric material to accommodate ammunition 69 of various diameters or leather to accommodate ammunition 69 of a pre-determined diameter. Furthermore, each of the plurality of arches 68 may be formed in various sizes to accommodate a wide variety of sizes of ammunition 69. Each of the strip attachment points 66 may comprise stitching that extends through the respective strip and the front flap 16. A single strip 64 might be provided, a pair of the strips 64 might be provided or any number of strips 64 that are determined to be most beneficial.

A button 82 is coupled to and extends away from the front flap 16 thereby facilitating the button 82 to be gripped for inserting or removing the rear flap 14 in the pocket 18 on the article of clothing 20. The button 82 comprises a stem 84 extending away from the forward surface 40 of the front flap 16 and a head 86 disposed on a distal end 88 of the stem 84 with respect to the forward surface 40. The stem 84 is positioned closer to the topmost strip 78 than the top end 26 of the front flap 16. Additionally, the stem 84 is centrally positioned between the first lateral edge 74 and the second lateral edge 76 of the front flap 16. Additionally, the button 82 can be inserted through a button hole 83 in a flap 85 of the pocket 18 in which the pocket insert 12 is positioned for securing the pocket insert 12 in the pocket 18.

A lanyard 90 is removably attached to the front flap 16 such that the lanyard 90 can be wrapped around a respective one of the user's legs 92 when the rear flap 14 is inserted into the user's 22 pants pocket 94. The lanyard 90 is continuous such that the lanyard 90 forms a closed loop. Additionally, the lanyard 90 is extended through the grommet 38 in the front flap 16 and the lanyard 90 is looped around itself on the bottom end 34 of the front flap 16 for retaining the lanyard 90 in the grommet 38. The lanyard 90 can be attached to a variety of hunting accessories, including but not being limited to, a game call, a compass and other accessories commonly employed while hunting. Furthermore, the lanyard 90 can be employed as a tourniquet in the event that the user 22 is injured while hunting or to serve a variety of first aid applications.

Figure 7:
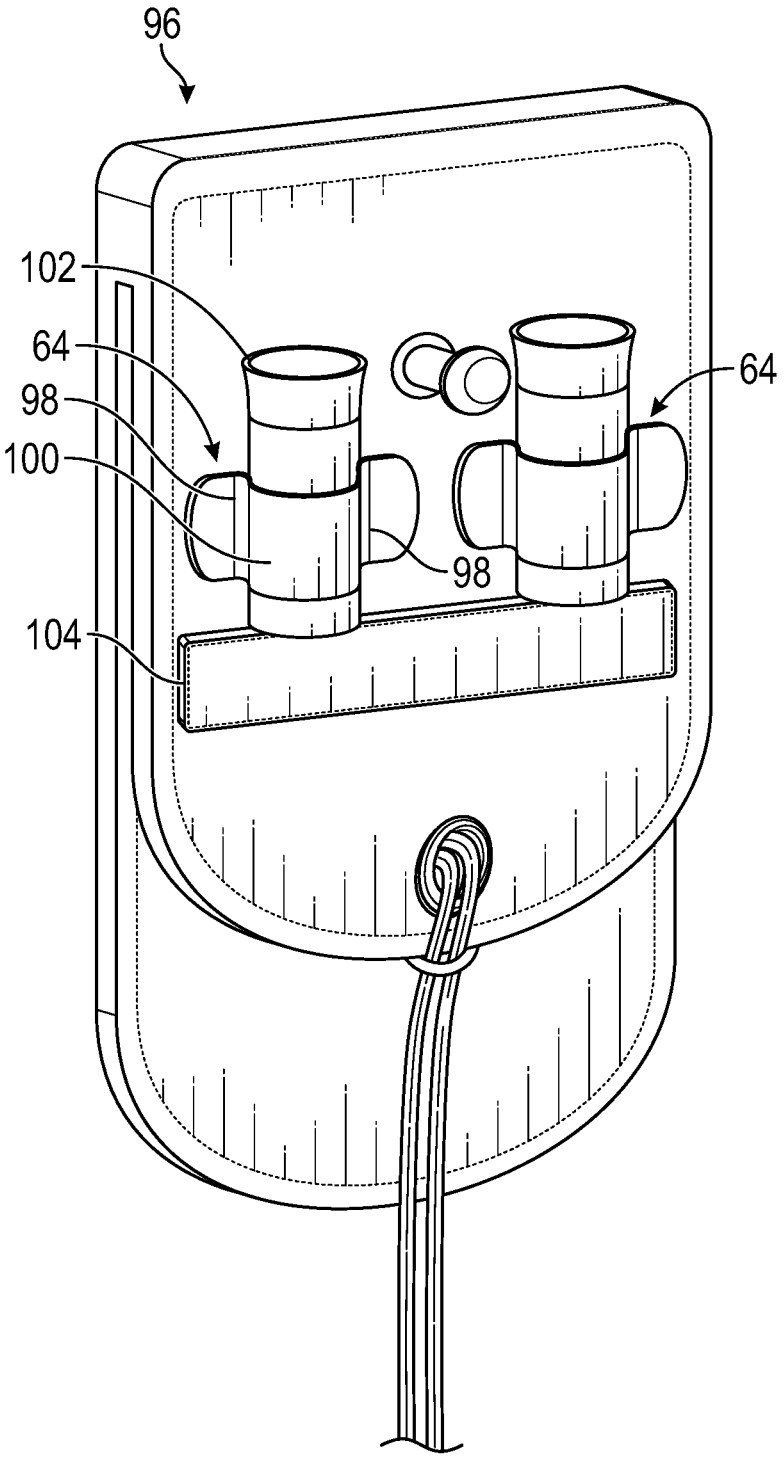
FIG. 7 is a front perspective view of an alternative embodiment of the disclosure.

In an alternative embodiment 96 as is most clearly shown in FIG. 7, each of the strips 64 has a pair of attachment points 98 located at a respective one of the first end 70 and the second end 72 of the strips 64 such that a single arch 100 is defined in each of the strips 64. In this way the single arch 100 defined in each of the strips 64 can insertably receive a shotgun shell 102 or other ammunition of a similar diameter. Furthermore, the strips 64 are each positioned on an axis extending between the first lateral edge 74 and the second lateral edge 76 of the front flap 16. Continuing in the alternative embodiment 96, a stop 104 may be attached to the forward surface 40 of the front flap 16 having the stop 104 extending substantially between the first lateral edge 74 and the second lateral edge 76 of the front flap 16. The stop 104 is positioned between the strips 64 and the lower end 36 of the front flap to facilitate the shotgun shell 102 in each of the strips 64 to rest against the stop 104 to inhibit the shotgun shell 102 in each of the strips from falling downwardly out of the strips 64.

In use, the hunting documents 60 are inserted into a respective sleeve 58 and the rear flap 14 is inserted into a respective pocket 18 on the article of clothing 20. Additionally, the ammunition 69 is inserted into the plurality of arches 68 in the strips 64. In this way the ammunition 69 is readily available to the user 22 while the user 22 is hunting. Additionally, the hunting documents 60 are easily accessible to the user 22 in the event that the user 22 must present the hunting documents 60 to law enforcement, for example. As is most clearly shown in FIG. 5, a plurality of the pocket inserts 12 can each be inserted into a various pockets 18 in the article of clothing 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An ammunition storage assembly for storing ammunition and hunting documents on a hunter's clothing, said assembly comprising:

a pocket insert having a rear flap being spaced from a front flap thereby facilitating said rear flap to be inserted into a pocket on an article of clothing wherein said front flap is configured to be accessible to a user wearing the article of clothing;

a pair of strips, each of said strips being attached to said front flap at a plurality of strip attachment points such that a plurality of arches is defined in each of said strips wherein each of said arches in each of said strips is configured to insertably receive a round of ammunition for storage;

a button being coupled to and extending away from said front flap wherein said button is configured to be gripped for inserting or removing said rear flap in the pocket on the article of clothing; and a lanyard being removably attached to said front flap wherein said lanyard is configured to be wrapped around a respective one of the user's legs when said rear flap is inserted into the user's pants pocket.

2. The assembly according to claim 1, wherein:

said pocket insert has a central portion extending between a top end of said front flap and an upper end of said rear flap such that a rear surface of said front flap is spaced from a front surface of said rear flap;

said rear flap has a length being greater than a length of said front flap such that a bottom end of said rear flap is spaced below a lower end of said front flap, each of said bottom end and said lower end being rounded; and said front flap has a grommet extending through a forward surface of said front flap and said rear surface of said front flap such that said grommet defines an opening in said front flap, said grommet being spaced from said lower end of said front flap.

3. The assembly according to claim 2, wherein:

said assembly includes a panel having an upper end, a lower end, a first lateral side and a second lateral side, said panel having a plurality of panel attachment points each engaging a back surface of said rear flap, each of said plurality of panel attachment points extending between said first lateral side and said second lateral side, said plurality of panel attachment points being spaced apart from each other and being evenly distributed between said upper end and said lower end of said panel thereby defining a pair of sleeves between respective pairs of said panel attachment points wherein each of said sleeves is configured to insertably receive respective hunting documents for storage; and said each of said first lateral side and said second lateral side is scalloped between said upper end and said lower end, each of said scallops being aligned with a respective one of said sleeves defined in said panel.

4. The assembly according to claim 2, wherein each of said strips has a first end and a second end, each of said pair of strips being positioned on said forward surface of said front flap, each of said plurality of strip attachment points being spaced apart from each other and being distributed between said first end and said second end of a respective one of said pair of strips.

5. The assembly according to claim 4, wherein each of said pair of strips extends substantially between a first lateral edge and a second lateral edge of said front flap, said pair of strips being spaced apart from each other and being distributed between said top end and said bottom end of said front flap having said plurality arches in a topmost one of said pair of strips being aligned with a respective one of said arches in a bottommost one of said pair of strips.

6. The assembly according to claim 5, wherein said button comprises a stem extending away from said forward surface of said front flap and a head disposed on a distal end of said stem with respect to said forward surface, said stem being positioned closer to said topmost strip than said top end of said front flap, said stem being centrally positioned between said first lateral edge and said second lateral edge of said front flap.

7. The assembly according to claim 2, wherein said lanyard is continuous such that said lanyard forms a closed loop, said lanyard being extended through said grommet in said front flap, said lanyard being looped around itself on said bottom end of said front flap for retaining said lanyard in said grommet.

8. An ammunition storage assembly for storing ammunition and hunting documents on a hunter's clothing, said assembly comprising:

a pocket insert having a rear flap being spaced from a front flap thereby facilitating said rear flap to be inserted into a pocket on an article of clothing wherein said front flap is configured to be accessible to a user wearing the article of clothing, said pocket insert having a central portion extending between a top end of said front flap and an upper end of said rear flap such that a rear surface of said front flap is spaced from a front surface of said rear flap, said rear flap having a length being greater than a length of said front flap such that a bottom end of said rear flap is spaced below a lower end of said front flap, each of said bottom end and said lower end being rounded, said front flap having a grommet extending through a forward surface of said front flap and said rear surface of said front flap such that said grommet defines an opening in said front flap, said grommet being spaced from said lower end of said front flap;

a panel having an upper end, a lower end, a first lateral side and a second lateral side, said panel having a plurality of panel attachment points each engaging a back surface of said rear flap, each of said plurality of panel attachment points extending between said first lateral side and said second lateral side, said plurality of panel attachment points being spaced apart from each other and being evenly distributed between said upper end and said lower end of said panel thereby defining a pair of sleeves between respective pairs of said panel attachment points wherein each of said sleeves is configured to insertably receive respective hunting documents for storage, said each of said first lateral side and said second lateral side being scalloped between said upper end and said lower end, each of said scallops being aligned with a respective one of said sleeves defined in said panel;

a pair of strips, each of said strips being attached to said front flap at a plurality of strip attachment points such that a plurality of arches is defined in each of said strips wherein each of said arches in each of said strips is configured to insertably receive a round of ammunition for storage, each of said strips having a first end and a second end, each of said pair of strips being positioned on said forward surface of said front flap, each of said plurality of strip attachment points being spaced apart from each other and being distributed between said first end and said second end of a respective one of said pair of strips, each of said pair of strips extending substantially between a first lateral edge and a second lateral edge of said front flap, said pair of strips being spaced apart from each other and being distributed between said top end and said bottom end of said front flap having said plurality of arches in a topmost one of said pair of strips being aligned with a respective one of said arches in a bottommost one of said pair of strips;

a button being coupled to and extending away from said front flap wherein said button is configured to be gripped for inserting or removing said rear flap in the pocket on the article of clothing, said button comprising a stem extending away from said forward surface of said front flap and a head disposed on a distal end of said stem with respect to said forward surface, said stem being positioned closer to said topmost strip than said top end of said front flap, said stem being centrally positioned between said first lateral edge and said second lateral edge of said front flap; and a lanyard being removably attached to said front flap wherein said lanyard is configured to be wrapped around a respective one of the user's legs when said rear flap is inserted into the user's pants pocket, said lanyard being continuous such that said lanyard forms a closed loop, said lanyard being extended through said grommet in said front flap, said lanyard being looped around itself on said bottom end of said front flap for retaining said lanyard in said grommet.

* * * * *